US006764814B2

(12) United States Patent
Magee et al.

(10) Patent No.: US 6,764,814 B2
(45) Date of Patent: Jul. 20, 2004

(54) PHOTOGRAPHIC DEVELOPING COMPOSITION AND USE THEREOF IN THE DEVELOPMENT OF A PHOTOGRAPHIC ELEMENT

(75) Inventors: Paul M. Magee, London (GB); Brian J. Parker, Hertfordshire (GB); Nicholas A. Pightling, Ruislip Manor (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/051,667

(22) Filed: Jan. 18, 2002

(65) Prior Publication Data

US 2002/0155396 A1 Oct. 24, 2002

(30) Foreign Application Priority Data

Feb. 13, 2001 (GB) ..... 0103527

(51) Int. Cl.[7] ..... G03C 5/305
(52) U.S. Cl. ..... 430/488
(58) Field of Search ..... 430/488

(56) References Cited

U.S. PATENT DOCUMENTS

| | | | | |
|---|---|---|---|---|
| 3,926,632 A | | 12/1975 | Hofman et al. | 430/265 |
| 4,141,734 A | * | 2/1979 | Lenoir et al. | 430/445 |
| 4,254,215 A | | 3/1981 | Kramp et al. | 430/419 |
| 4,521,508 A | | 6/1985 | Sugimoto et al. | 430/567 |
| 4,740,438 A | | 4/1988 | Krishnamurthy | 430/17 |
| 4,975,354 A | | 12/1990 | Machonkin et al. | 430/264 |
| 5,240,823 A | | 8/1993 | Yamada et al. | 430/488 |
| 5,418,127 A | | 5/1995 | Budz et al. | 430/611 |
| 5,510,231 A | * | 4/1996 | Komatsu et al. | 430/399 |
| 5,683,859 A | | 11/1997 | Nothnagle et al. | 430/488 |
| 5,691,108 A | * | 11/1997 | Hirano et al. | 430/264 |
| 5,725,998 A | * | 3/1998 | Sanpei | 430/399 |
| 5,821,040 A | * | 10/1998 | Okutsu et al. | 430/440 |

FOREIGN PATENT DOCUMENTS

| | | |
|---|---|---|
| EP | 0 566 323 A | 10/1993 |
| JP | 4-299338 | 10/1992 |
| JP | 6-258780 | 9/1994 |
| JP | 7-311430 | 11/1995 |

OTHER PUBLICATIONS

JP Abstract 07311430.
JP Abstract 04299338.
JP Abstract 06258780.

* cited by examiner

*Primary Examiner*—Hoa Van Le

(57) ABSTRACT

A photographic developer composition for use in the development of a black and white silver halide photographic element said composition comprises at least one developing agent and, in an amount sufficient to inhibit sludge deposition, one or more compounds selected from compounds having the formula $$X—R^1—CONH—A—S—S—B—NHCO—R^2—Y \quad (I)$$

wherein

A and B are each independently a substituted or unsubstituted aliphatic, alicyclic, aromatic or heterocyclic group;
$R^1$ and $R^2$ are each independently a substituted or unsubstituted aliphatic, alicyclic, aromatic or heterocyclic group;
X and Y are each independently a solubilising group; and compounds having the formula $$X—R^1—CONH—A—S—M \quad (II)$$

wherein A, $R^1$ and X are as defined above, and
M is either a hydrogen atom or a cationic species if the sulfur atom is in its ionized form.

15 Claims, 2 Drawing Sheets

PHOTOGRAPHIC DEVELOPING COMPOSITION AND USE THEREOF IN THE DEVELOPMENT OF A PHOTOGRAPHIC ELEMENT

FIELD OF THE INVENTION

The invention relates to photography and in particular to the development of silver halide photographic elements.

BACKGROUND OF THE INVENTION

In the development of black-and-white silver halide photographic elements a commonly encountered problem is the accumulation of "sludge" or "dirt" in the developing composition. While the mechanisms whereby such sludge is formed are varied and complex, an important contributing factor is the presence in developing compositions of compounds such as sulfites which dissolve silver halides and form silver complexes. The silver complexes that are extracted from the photographic element into the developing composition are reduced by other components of the developing composition and converted to extremely fine particles of metallic silver which are commonly referred to in the art as "silver sludge." The formation of this silver sludge is a particularly serious problem when the photographic elements are processed in an automatic processing apparatus. Thus, for example, it is common for the sludge to attach to the walls of the developing tank and/or the rollers of an automatic processor and the particles can subsequently transfer to the photographic element. The result can manifest itself as black silver specks or silver stain and, if sufficiently severe, this can render the photographic element useless for its intended purpose. The problem can be alleviated to some extent by frequent cleaning of the processing equipment to remove accumulated silver sludge, but this adds significantly to the effort and expense of the processing operation. The problem of reducing or avoiding the deposition of silver sludge has been a very longstanding problem in the photographic art. A wide variety of compounds has been proposed heretofore as sludge-inhibiting agents. Their effectiveness for this purpose is often insufficient. Moreover, agents used to reduce sludge formation can have unwanted side effects such as suppressing development or adversely affecting the contrast of the photographic element. Sulfites are very commonly used in black-and-white developing compositions where they serve to extend the life of the developing composition by protecting it against aerial oxidation. While they are a major contributor to sludge formation they are not the only one. Other factors contributing to sludge formation include the throughput of sensitized material, the replenishment rate, the time of development, the developing agent and the design of the processing apparatus. Generally speaking, most, if not all, black-and-white developing compositions suffer from the problem of sludge formation, although the degree to which it occurs varies widely depending upon both the components of the developing composition and the composition of the photographic element being processed. U.S. Pat. No. 4,975,354 describes silver halide photographic elements having incorporated therein a hydrazine compound which functions as a nucleator and an amino compound which functions as an incorporated booster. Such elements provide a highly desirable combination of high photographic speed, very high contrast and excellent dot quality, which renders them very useful in the field of graphic arts. Moreover, since they incorporate the booster in the photographic element, rather than using a developing solution containing a booster, they have the further advantage that they are processable in conventional, low cost, rapid-access developers. Other patents describing silver halide photographic elements comprising a hydrazine compound which functions as a nucleator and an amino compound which functions as an incorporated booster include U.S. Pat. No. 4,914,003 and U.S. Pat. No. 5,030,547. Nucleated high-contrast photographic elements of the type described hereinabove are particularly prone to the formation of silver sludge. While the reason for this is not clearly understood, it has been a significant factor hindering the commercial utilization of such otherwise advantageous photographic elements in the field of graphic arts. The present invention is directed toward the objective of providing an improved developing composition, useful with a wide variety of black-and-white silver halide photographic elements, that has less tendency to deposit sludge than developing compositions utilized heretofore. It is a particular objective of the invention to provide an improved process for developing high contrast photographic elements, containing a hydrazine compound which functions as a nucleator and an amino compound which functions as an incorporated booster, utilizing the improved black-and-white developing composition of this invention.

U.S. Pat. No. 4,254,215 describes a process for the prevention of darkening and the formation of a sediment in photographic developer solutions by adding a combination of a mercapto compound and a Bunte salt to the developer solution. The mercapto compound may be a thiol of the formula HS—D—$(W)_n$ where D is a substituted or unsubstituted aliphatic, araliphatic, cycloaliphatic, aromatic or heterocyclic radical and W may be a group of the type—$CONH_2$.

Problem to be solved by the Invention

It is an aim of the invention to provide an alternative developer composition in which silver sludge formation is reduced.

It is an aim of the invention to provide a developer composition containing a silver antisludging agent in which the rate of loss of antisludging activity on dilution is decreased.

It is an aim of the invention to provide a developer composition containing a silver antisludging agent in which the loss of antisludging activity on prolonged keeping is diminished.

SUMMARY OF THE INVENTION

In one aspect the invention provides a photographic developer composition for use in the development of a black and white silver halide photographic element said composition comprising at least one developing agent and, in an amount sufficient to inhibit sludge deposition, one or more compounds selected from compounds having the formula $$X—R^1—CONH—A—S—S—B—NHCO—R^2—Y \quad (I)$$

wherein

A and B are each independently a substituted or unsubstituted aliphatic, alicyclic, aromatic or heterocyclic group;

$R^1$ and $R^2$ are each independently a substituted or unsubstituted aliphatic, alicyclic, aromatic or heterocyclic group;

X and Y are each independently a solubilising group;

and compounds having the formula $$X—R^1—CONH—A—S—M \quad (II)$$

wherein A, $R^1$ and X are as defined above, and

M is either a hydrogen atom or a cationic species if the sulfur atom is in its ionised form.

In another aspect, the invention provides a method of forming a photographic image in a black and white silver halide photographic element which comprises imagewise exposing the photographic element and developing the exposed element with a developing composition comprising at least one developing agent and, in an amount sufficient to inhibit sludge deposition, a compound having the formula (I) and/or (II) as defined above.

In another aspect, the invention provides a black and white silver halide photographic element comprising a support having thereon at least one light-sensitive silver halide emulsion layer said element comprising, in an amount sufficient to inhibit sludge deposition during development, a compound having the formula (I) and/or (II) as defined above.

Advantageous Effect of the Invention

Use of the developer composition of the invention reduces sludge formation.

The antisludging activity of the developer composition diminishes only gradually on dilution.

The antisludging activity loss of the developer composition on prolonged keeping is diminished.

DETAILED DESCRIPTION OF THE INVENTION

Figure 1:
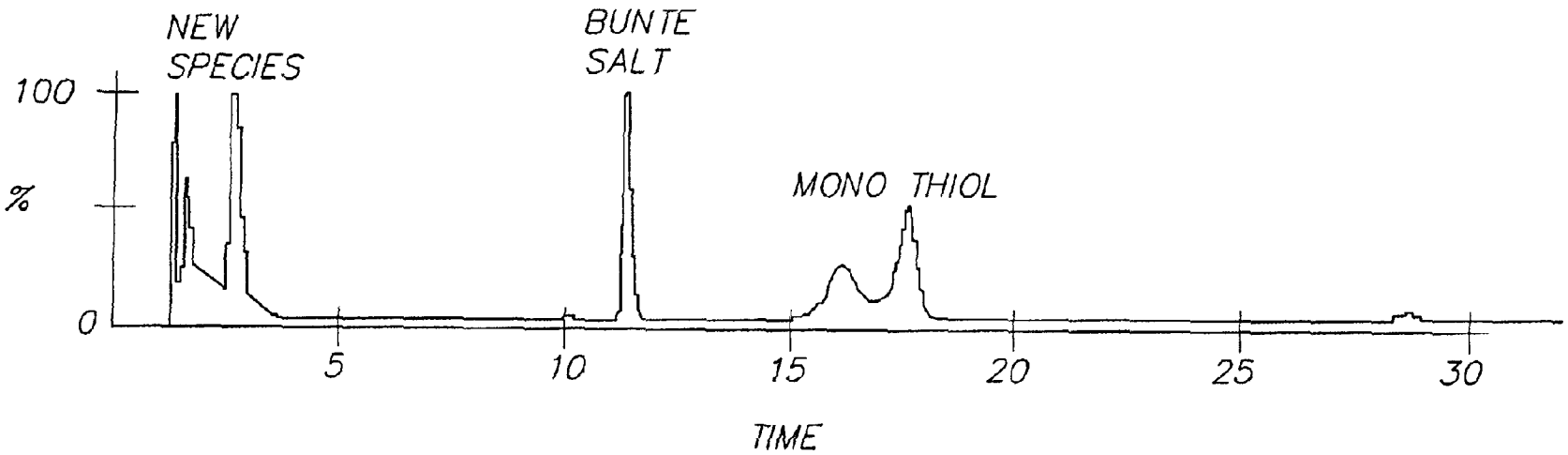
FIGS. 1 to 3 show the concentration of various components of the developer compositions used in Example 2.

The developing compositions of this invention are useful for forming black-and-white silver images by development of light-sensitive silver halide photographic elements of many different types, including, for example, microfilms, aerial films and X-ray films. They are especially useful in the field of graphic arts for forming very high contrast silver images. In the graphic arts field, they can be used with a wide variety of graphic arts films.

Regarding the compounds (I) and (II), A and B may be selected from a substituted or unsubstituted alkylene group having from 1 to 12, preferably from 1 to 6 carbon atoms, a cycloalkylene group having from 5 to 8, preferably from 5 to 6 ring carbon atoms, an aromatic group having from 5 to 10, preferably from 5 to 6 ring carbon atoms, (e.g. a fused aromatic group having from 9 to 10 carbon atoms), a heterocyclic group having from 5 to 10, preferably from 5 to 6 ring atoms (e.g. a fused heterocyclic group having from 9 to 10 ring atoms), said ring atoms being selected from selected from C, N, S, and O.

Particularly preferred A and B groups include phenylene.

Examples of substituents for the A and B groups include alkyl groups (e.g. methyl, ethyl, hexyl), haloalkyl groups (e.g. trifluoromethyl, trichloromethyl, tribromomethyl), alkoxy groups (e.g. methoxy, ethoxy, octyloxy), aryl groups (e.g. phenyl, naphthyl, tolyl), hydroxy groups, halogen atoms, aryloxy groups (e.g. phenyloxy, alkylthio groups (e.g. methylthio, butylthio), arylthio groups (e.g. phenylthio), acyl groups (e.g. acetyl, proprionyl, butyryl, valeryl), sulfonyl groups (e.g. methylsulfonyl, phenylsulfonyl), acylamino groups, sulfonylamino groups, acyloxy groups (e.g. acetoxy, benzoxy), cyano groups, amino groups, groups represented by X and Y as defined above and groups represented by X—$R^1$—CONH— and Y—$R^2$—CONH— as defined above.

$R^1$ and $R^2$ may be selected from a substituted or unsubstituted alkylene group having from 1 to 12, preferably from 1 to 6 carbon atoms, a cycloalkylene group having from 5 to 8, preferably from 5 to 6 ring carbon atoms, an aromatic group having from 5 to 10, preferably from 5 to 6 ring carbon atoms, (e.g. a fused aromatic group having from 9 to 10 carbon atoms), a heterocyclic group having from 5 to 10, preferably from 5 to 6 ring atoms (e.g. a fused heterocyclic group having from 9 to 10 ring atoms), said ring atoms being selected from selected from C, N, S, and O.

Examples of substituents for the $R^1$ and $R^2$ groups include alkyl groups (e.g. methyl, ethyl, hexyl), haloalkyl groups (e.g. trifluoromethyl, trichloromethyl, tribromomethyl), alkoxy groups (e.g. methoxy, ethoxy, octyloxy), aryl groups (e.g. phenyl, naphthyl, tolyl), hydroxy groups, halogen atoms, aryloxy groups (e.g. phenyloxy, alkylthio groups (e.g. methylthio, butylthio), arylthio groups (e.g. phenylthio), acyl groups (e.g. acetyl, proprionyl, butyryl, valeryl), sulfonyl groups (e.g. methylsulfonyl, phenylsulfonyl), acylamino groups, sulfonylamino groups, acyloxy groups (e.g. acetoxy, benzoxy), cyano groups, amino groups and groups represented by X and Y.

Particularly preferred $R^1$ and $R^2$ groups include —$(CH_2)_{2\text{-}4}$—, especially —$(CH_2)_3$—.

Suitable X and Y groups are those which enhance the solubility of the compound when the developer composition is in solution form. Preferred groups are water solubilising groups including quaternary ammonium groups and carboxylic, sulfonic, sulfinic and phosphonic groups in acid or salt form e.g. COOM wherein M is either a hydrogen atom or a cationic species if the carboxyl group is in its ionised form. The cationic species may be a metal ion or an organic ion. Examples of organic cations include ammonium ions (e.g. ammonium, tetramethylammonium, tetrabutylammonium), phosphonium ions (e.g. tetraphenylphosphonium), and guanidyl groups. Preferably, M is hydrogen or an alkali metal cation, with a sodium or potassium ion being most preferred. The developer solution may comprise a proportion of non-aqueous solvent e.g. diethylene glycol. Marginal water soluble groups may then be chosen. Examples of such groups include acyloxy, alkoxy and aryloxy groups.

In a particularly preferred embodiment of the invention, the antisludging agent comprises para-glutaramidophenyldisulfide (the compound of formula (I) wherein A and B each represent paraphenylene, $R^1$ and $R^2$ each represent —$(CH_2)_3$— and, X and Y each represent —COOM wherein M is either a hydrogen atom or a cationic species if the carboxyl group is in its ionised form).

The antisludging agent may be present in the developer composition in an amount sufficient to provide a concentration of from $7\times10^{-6}$ to $7\times10^{-3}$ mol/l, preferably from $3.5\times10^{-5}$ to $3.5\times10^{-3}$ mol/l, and most preferably from $7\times10^{-5}$ to $2\times10^{-3}$ mol/l of working strength developing solution.

The developer composition may further comprise a compound having the formula $$Q—S—H \qquad (III)$$

wherein Q represents a substituted or unsubstituted heterocyclic group, the silver salt of said compound being water insoluble The heterocyclic group, including fused heterocyclic groups, may have from 5 to 10 ring atoms selected from C, N, S, and O.

Examples of suitable heterocyclic groups include thiazole, oxazole, oxathiazole, imidazole, diazole, triazole, tetrazole, isodiazole, thiadiazole, thiatriazole, pyridine, pyrimidine, quinoline, triazine, azaindine, purine, oxadiazole and such compounds having one or more additional fused rings e.g a benzo ring (e.g. benzothiazole, bezoxazole, benzimidazole and benzotriazole).

Specific examples of suitable compounds of formula (III) include 2-mercaptobenzothiazole, 2-mercaptopyrimidine, 2-mercapto-5-methylbenzimidazole, 2-mercaptobenzoxazole and 5-mercapto-1-phenyltetrazole.

Compound (III) may be present in the developer composition in an amount sufficient to provide a concentration of from $2\times10^{-5}$ to $5\times10^{-3}$ mol/l, preferably from $5\times10^{-5}$ to $3\times10^{-3}$ mol/l, and most preferably from $1\times10^{-4}$ to $1.5\times10^{-3}$ mol/l of working strength developing solution.

The addition of a compound (III) to a developer composition containing compounds (I) and/or (II) enhances the effect of these compounds in reducing the silver sludging during processing, particularly at low replenishment rates, but surprisingly do not show any precipitation. Thus, by adding an appropriate amount of compound (III) to the developer, the levels of compounds (I) and/or (II) can be reduced.

The disulfides of formula (I) are attacked by sulfite when present in the developer composition to form a thiol of formula (II) and a Bunte salt. The developer composition may further comprise a compound that promotes the formation of the thiol of formula (II) during the breakdown of the disulfides of formula (I). Without wishing to be limited to any particular reaction mechanism, it is believed that the active antisludging species are the disulfides of formula (I) and the thiols of formula (II). By promoting the formation of the thiols of formula (II), the maximum efficiency can be obtained.

Examples of suitable thiol promoting compounds include sugar derivatives (e.g. ascorbates, isoascorbates, erythorbates, and piperidine hexose reductone), mercaptocarboxylic acids (e.g. mercaptosuccinic acid and cysteine), and compounds selected from those having formula (III) above whose silver salts may be water insoluble or water soluble (e.g. 5-mercaptobenzotriazole).

The thiol promoting sugar derivatives may be present in the developer composition in an amount sufficient to provide a concentration of from $2\times10^{-4}$ to $7\times10^{-2}$ mol/l, preferably from $2\times10^{-3}$ to $3\times10^{-2}$, and most preferably from $6\times10^{-3}$ to $2\times10^{-2}$ mol/l of working strength developing solution.

The other thiol promoting compounds may be present in the developer composition in an amount sufficient to provide a concentration of from $2\times10^{-5}$ to $2\times10^{-2}$ mol/l, preferably from $1\times10^{-4}$ to $1\times10^{-2}$, and most preferably from $2\times10^{-4}$ to $2\times10^{-3}$ mol/l of working strength developing solution.

The developer composition of the invention may be in the form of a liquid concentrate, or a solid, powder, slurry or paste formulation from which a working strength solution can be made by dissolution or dilution. Alternatively, one or more of the compounds (I), (II), (III) and the thiol promoting compounds described above can be added to a working strength developer solution to provide the composition of the invention. In a particular embodiment, one or more of the compounds (I), (II), (III) and the thiol promoting compounds may be present in a photographic element being developed so that the compound(s) is (are) added to the developing solution during development.

The present invention is most effectively employed in conjunction with or without the use of an in-line filter through which the developing solution is recirculated. While applicants do not wish to be bound by any theoretical explanation of the manner in which their invention functions, it is believed that the antisludging agent functions in the developing solution to bind cationic silver ions to form a soluble in solution complex that will not for form silver insoluble complexes. The effect of utilizing an antisludging agent is to render the photographic developer solution cleaner working. In practice the antisludging agent can be introduced to the developing solution at manufacturing as a concentrate, prior to use as a concentrate, prior to use as in a working strength developing solution or added intermittently during the operation of the photographic processor.

In the practice of this invention, the antisludging agent is preferably added to the developer concentrate during manufacture. In the field of graphic arts, it has long been known to achieve high contrast by the use of low sulfite "lith" developers. In conventional "lith" developers, high contrast is achieved using the "lith effect" (also referred to as infectious development) as described by J. A. C. Yule in the Journal of the Franklin Institute, Vol. 239, 221–230 (1945). This type of development is believed to proceed autocatalytically. To achieve "lith effect" development, a low, but critical concentration of free sulfite ion is maintained by use of an aldehyde bisulfite adduct, such as sodium formaldehyde bisulfite, which, in effect, acts as a sulfite ion buffer. The low sulfite ion concentration is necessary to avoid interference with the accumulation of developing agent oxidation products, since such interference can result in prevention of infectious development. The developer typically contains only a single type of developing agent, namely, a developing agent of the dihydroxybenzene type, such as hydroquinone.

Photographic elements utilizing a hydrazine compound that functions as a nucleating agent are not ordinarily processed in conventional "lith" developers but in developers that contain substantially higher amounts of sulfite as described, for example, in such Patents as U.S. Pat. Nos. 4,269,929, 4,914,003, 4,975,354 and 5,030,547.

Developers which contain high concentrations of sulfite are especially prone to the deposition of silver sludge.

The novel photographic developing composition of this invention includes at least one of the conventional developing agents utilized in black-and-white processing. Such developing agents include dihydroxybenzene developing agents, ascorbic acid developing agents, aminophenol developing agents, and 3-pyrazolidone developing agents.

The dihydroxybenzene developing agents which can be employed in the developing compositions of this invention are well known and widely used in photographic processing. The preferred developing agent of this class is hydroquinone. Other useful dihydroxybenzene developing agents include:

chlorohydroquinone,
bromohydroquinone,
isopropylhydroquinone,
toluhydroquinone,
methylhydroquinone,
2,3-dichlorohydroquinone,
2,5-dimethylhydroquinone,
2,3-dibromohydroquinone,
1,4-dihydroxy-2-acetophenone-2,4-dimethyl-hydroquinone
2,5-diethylhydroquinone,
2,5-di-p-phenethylhydroquinone,
2,5-dibenzoylaminohydroquinone, and
2,5-diacetaminohydroquinone.

Ascorbic acid developing agents have been utilized heretofore in a wide variety of photographic developing processes. Thus, for example, U.S. Pat. Nos. 2,688,548 and 2,688,549 disclose developing compositions containing ascorbic acid developing agents and 3-pyrazolidone developing agents; U.S. Pat. No. 3,022,168 discloses developing compositions containing ascorbic acid developing agents and activating developers such as N-methyl-p-aminophenol; U.S. Pat. No. 3,512,981 discloses developing compositions containing a dihydroxybenzene developing agent such as hydroquinone, a sulfite and an ascorbic acid developing agent; U.S. Pat. No. 3,870,479 discloses a lithographic-type diffusion transfer developer containing an ascorbic acid developing agent; U.S. Pat. No. 3,942,985 describes developing solutions containing an ascorbic acid developing agent and a iron chelate developer; U.S. Pat. Nos. 4,168,977, 4,478,928 and 4,650,746 disclose the use of an ascorbic acid developing agent in processes in which a high contrast photographic element is developed in the presence of a hydrazine compound; U.S. Pat. Nos. 4,839,259 and 4,997,743 disclose high contrast photographic elements containing a hydrazine compound and an incorporated ascorbic acid developing agent, and U.S. Pat. No. 4,975,354 discloses the use of an ascorbic acid developing agent in developing high contrast photographic elements containing both a hydrazine compound that functions as a nucleating agent and an amino compound that functions as an incorporated booster.

By the term "an ascorbic acid developing agent", as used herein, it is intended to include ascorbic acid and the analogues, isomers and derivatives thereof which function as photographic developing agents. Ascorbic acid developing agents are very well known in the photographic art (see the references cited hereinabove) and include, for example, the following compounds:

L-ascorbic acid
D-ascorbic acid
L-erythroascorbic acid
D-glucoascorbic acid
6-desoxy-L-ascorbic acid
L-rhamnoascorbic acid
D-glucoheptoascorbic acid
imino-L-erythroascorbic acid
imino-D-glucoascorbic acid
imino-6-desoxy-L-ascorbic acid
imino-D-glucoheptoascorbic acid
sodium isoascorbate
L-glycoascorbic acid
D-galactoascorbic acid
L-araboascorbic acid
sorboascorbic acid, and
sodium ascorbate.

Developing compositions which utilize a primary developing agent, such as a dihydroxybenzene developing agent or an ascorbic acid developing agent, frequently also contain an auxiliary super-additive developing agent. Examples of useful auxiliary super-additive developing agents are aminophenols and 3-pyrazolidones.

The auxiliary super-additive developing agents that can be employed in the developing compositions of this invention are well known and widely used in photographic processing. As explained in Mason, "Photographic Processing Chemistry", Focal Press, London, 1975, "superadditivity" refers to a synergistic effect whereby the combined activity of a mixture of two developing agents is greater than the sum of the two activities when each agent is used alone in the same developing solution (Note especially the paragraph entitled, "Superadditivity" on Page 29 of Mason).

For the purposes of this invention, the preferred auxiliary super-additive developing agents are the 3-pyrazolidone developing agents (also known as "phenidone" type developing agents). Particularly preferred developing agents of this class are disclosed in U.S. Pat. Nos. 5,457,011, 5,780,212, 5,837,434, 5,942,379 and 6,083,673. The most commonly used developing agents of this class are 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 4-hydroxymethyl-4-methyl-1-phenyl-3-pyrazolidone, 5-phenyl-3-pyrazolidone, 1-p-aminophenyl-4,4-dimethyl-3-pyrazolidone, 1-p-tolyl-4-hydroxymethyl-4-methyl-3-pyrazolidone and 1-phenyl-4,4-dihydroxymethyl-3-pyrazolidone. Other useful 3-pyrazolidone developing agents include:

1-phenyl-5-methyl-3-pyrazolidone,
1-phenyl-4,4-diethyl-3-pyrazolidone,
1-p-aminophenyl-4-methyl-4-propyl-3-pyrazolidone,
1-p-chlorophenyl-4-methyl-4-ethyl-3-pyrazolidone,
1-p-acetamidophenyl-4,4-diethyl-3-pyrazolidone,
1-p-betahydroxyethylphenyl-4,4-dimethyl-3-pyrazolidone,
1-p-hydroxyphenyl-4,4-dimethyl-3-pyrazolidone,
1-p-methoxyphenyl-4,4-diethyl-3-pyrazolidone,
1-p-tolyl-4,4-dimethyl-3-pyrazolidone, and the like.

Other useful auxiliary co-developing agents comprise one or more solubilizing groups, such as sulfo, carboxy or hydroxy groups attached to aliphaticchains or aromatic rings, and preferably attached to the hydroxymethyl function of a pyrazolidone, as described for example, in U.S. Pat. No. 5,837,434 (Roussilhe et al). A most preferred auxiliary co-developing agent is 4-hydroxymethyl-4-methyl-1-phenyl-3-pyrazolidone.

Useful auxiliary super-additive developing agents for use in the aqueous alkaline developing compositions of this invention are aminophenols. Examples of useful aminophenols include:

p-aminophenol
o-aminophenol
N-methylaminophenol
2,4-diaminophenol hydrochloride
N-(4-hydroxyphenyl)glycine
p-benzylaminophenol hydrochloride
2,4-diamino-6-methylphenol
2,4-diaminoresorcinol, and
N-(beta-hydroxyethyl)-p-aminophenol.

More than one primary developing agent can be used in the developing compositions of this invention. For example, the developing composition can contain two different dihydroxybenzene developing agents or two different ascorbic acid developing agents or both a dihydroxybenzene developing agent and an ascorbic acid developing agent. More than one auxiliary super-additive developing agent can be included in the developing compositions of this invention. For example, the developing compositions can contain two different aminophenol developing agents or two different 3-pyrazolidone developing agents or both an aminophenol developing agent and a 3-pyrazolidone developing agent.

In addition to one or more developing agents and the compounds described above, the novel developing compositions of this invention preferably also contain a sulfite preservative.

By the term "sulfite preservative" as used herein is meant any sulfur compound that is capable of forming sulfite ions in aqueous alkaline solution. Examples of such compounds include alkali metal sulfites, alkali metal bisulfites, alkali metal metabisulfites, sulfurous acid and carbonyl-bisulfite adducts.

Examples of preferred sulfites for use in the developing solutions of this invention include sodium sulfite ($Na_2 SO_3$), potassium sulfite ($K_2 SO_3$), lithium sulfite ($Li_2 SO_3$), sodium bisulfite ($NaHSO_3$), potassium bisulfite ($KHSO_3$), lithium bisulfite ($LiHSO_3$), sodium metabisulfite ($Na_2S_2O5$), potassium metabisulfite ($K_2S_2O_5$), and lithium metabisulfite ($Li_2 S_2O_5$).

The carbonyl-bisulfite adducts which are useful in this invention are well-known compounds. See U.S. Pat. No. 5,457,011.

The amount of primary developing agent incorporated in the working strength developing solution can vary widely as desired. Typically, amounts of from about 0.05 to about 1.0 moles per liter are useful. Preferably, amounts in the range of from 0.1 to 0.5 moles per liter are employed.

The amount of auxiliary super-additive developing agent utilized in the working strength developing solution can vary widely as desired. Typically, amounts of from 0.001 to 0.1 moles per liter are useful. Preferably, amounts in the range of from 0.002 to 0.01 moles per liter are employed.

The amount of sulfite preservative utilized in the working strength developing solution can vary widely as desired. Typically, amounts of from 0.05 to 1.0 moles per liter are useful. Preferably amounts in the range of from 0.1 to 0.5 moles per liter are employed.

Working strength developing solutions prepared from the developing compositions of this invention typically have a pH in the range of from 8 to 13 and preferably in the range of from 9 to 11.5.

As indicated hereinabove, the deposition of silver sludge is a particularly serious problem with photographic elements that are processed in automatic machine processing equipment. Such devices employ numerous conveyance rollers on which silver sludge can deposit and from which it can transfer to the photographic element being processed. Automatic processing equipment utilizing conveyance rollers is very well known in the art and is described, for example, in U.S. Pat. Nos. 3,025,779, 3,545,971 and 4,310,622.

While the essential ingredients of the novel developing composition of this invention are at least one developing agent and at least one antisludging agent according to structure (I) and (II), a variety of other optional ingredients can also be advantageously included in the developing composition. For example, the developing composition can contain one or more antifoggants, antioxidants, sequestering agents, stabilizing agents or contrast-promoting agents. Such materials and preferred way of using them are described in U.S. Pat. No. 5,457,011.

Examples of particularly useful contrast-promoting agents are amino compounds as described, for example, in U.S. Pat. No. 4,269,929.

Examples of useful stabilizing agents are a-ketocarboxylic acids as described, for example, in U.S. Pat. No. 4,756,997.

In processing photographic elements with the developing compositions described herein, the time and temperature employed for development can be varied widely.

Typically, the development temperature will be in the range of from about 20° C. to about 50° C., more preferably in the range of from about 25° C. to about 40° C., while the development time will be in the range of from about 10 seconds to about 150 seconds, more preferably in the range of from about 20 seconds to about 120 seconds.

To prevent bacterial growth, a biocide can be included in the developer concentrate. Biocides that are especially useful for this purpose are the thiazole compounds, particularly isothiazolines such as 1,2-benzisothiazolin-3-one, 2-methyl-4-isothiazolin-3-one, 2-octyl-4-isothiazolin-3-one and 5-chloro-N-methyl-4-isothiazolin-3-one.

Photographic systems depending on the conjoint action of a hydrazinic compound that functions as a nucleating agent and an amino compound that functions as an incorporated booster are exceedingly complex and their successful utilization is critically dependent on being able to adequately control numerous properties including speed, contrast, dot quality, pepper fog, image spread, discrimination and practical density point. Such systems are strongly influenced not only by the composition of the photographic element but by the composition of the developing solution and by such factors as development pH, development time and development temperature.

The goal of achieving low pepper fog is one that is exceptionally difficult to achieve without sacrificing other desired properties such as speed and contrast. (The term "pepper fog" is commonly utilized in the photographic art, and refers to fog of a type characterized by numerous fine black specks). A particularly important film property is "discrimination", a term which is used to describe the ratio of the extent of shoulder development to pepper fog level. Good discrimination, i.e., full shoulder development with low pepper fog, is necessary to obtain good halftone dot quality. Any significant level of pepper fog is highly undesirable. Image spread is an additional undesirable consequence of the autocatalytic nucleation process. Development within an area of exposure, such as a halftone dot or a line, triggers nucleation at the dot or line edge to cause the dot or line to increase in size. The nucleated development outside the original exposed area, in turn, triggers further nucleation and the growth process continues with time of development at essentially a constant rate.

Any hydrazine compound that functions as a nucleator that is capable of being incorporated in the photographic element, and is capable of acting conjointly with the incorporated booster to provide high contrast, can be used in the practice of this invention. Many of such compounds are disclosed in U.S. Pat. No. 5,457,011. Typically, the hydrazine compound is incorporated in a silver halide emulsion used in forming the photographic element. Alternatively, the hydrazine compound can be present in a hydrophilic colloid layer of the photographic element, preferably a hydrophilic colloid layer that is coated to be contiguously adjacent to the emulsion layer in which the effects of the hydrazine compound are desired. It can, of course, be present in the photographic element distributed between or among emulsion and hydrophilic colloid layers, such as undercoating layers, interlayers and overcoating layers.

One photographic system in which this invention is useful employs a hydrazine compound as a nucleating agent and an amino compound as an incorporated booster. Amino compounds which are particularly effective as incorporated boosters are described in Machonkin and Kerr, U.S. Pat. No. 4,975,354. Other photographic systems will also find the developers provided by the invention useful. The silver halide in the photosensitive layers can be silver chloride, silver bromide, or silver iodobromide.

The antisludging agents have little or no adverse effect on the speed or other sensitometric properties of the photographic element. This is the case with both nucleated elements of the type described hereinabove and with conventional non-nucleated elements.

The antisludging agents useful in the invention are compounds which are known per se and which are prepared by known methods (see, for example, U.S. Pat. No. 5,418,127). Many are commercially available, including paraglutaramidophenyldisulfide used in the following Examples. An exemplary reaction scheme for preparing the disulfides of formula (I) involves reacting an aminophenyl disulfide or hydroxyphenyl disulfide with the appropriate cyclic anhydride followed by conversion of the free diacid to its anionic form using materials such as sodium bicarbonate. Other disulfides can be obtained by reacting aminophenyl disulfide or hydroxyphenyl disulfide with the mono chloride of a dicarboxylic acid mono ester, followed by hydrolysis of the ester to the carboxylic acid. The thiols of formula (II) can be formed by reduction of the disulfides of formula (I).

The invention is further illustrated by way of example as follows:

EXAMPLE 1

A photographic element was made consisting of an ESTAR™ support, an antihalation pelloid on the back of the support on which was coated, in the following order, a latent image forming emulsion layer, a gel interlayer and a protective supercoat.

The antihalation pelloid comprised a gelatin layer at a laydown of 2.0 g/m$^2$ containing absorber dyes as follows: 1,4-benzenedisulfonic acid, 2-(3-acetyl-4-(5-(3-acetyl-1-(2,5-disulfophenyl)-1,5-dihydro-5-oxo-4H-pyrazol-4-ylidene)-1,3-pentadienyl)-5-hydroxy-1H-pyrazol-1-yl)-, pentasodium salt at 60 mg/m$^2$; benzenesulfonic acid, 4-(4,5-dihydro-4-(5-(5-hydroxy-3-methyl-1-(4-sulfophenyl)-1H-pyrazol-4-yl)-2,4-pentadienylidene)-3-methyl-5-oxo-1H-pyrazol-1-yl)- at 67 mg/m$^2$ and 1H-Pyrazole-3-carboxylic acid, 4-(3-(3-carboxy-5-hydroxy-1-(4-sulfophenyl-1H-pyrazol-4-yl)-2-propenylidene)-4,5-dihydro-5-oxo-1-(4-sulfophenyl)-, sodium salt with N,N-diethylethanamine at 50 mg/m$^2$.

A second gelatin layer of 0.5 g/m$^2$ containing methacrylate matte beads at 30 mg/m$^2$ was overcoated to provide a suitable matte surface.

The latent image forming emulsion layer consisted of a 70:30 chlorobromide cubic dispersed emulsion (0.18 $\mu$m edge length) doped with a rhodium salt at 0.109 mg/Ag mole and an iridium salt at 0.265 mg/Ag mole. It was then chemically sensitised with sulphur and gold and spectrally sensitised with 400 mg/Ag mole of sensitising dye of the formula:

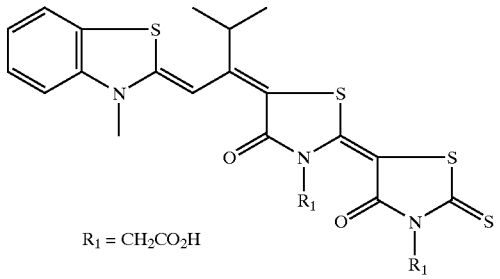

The emulsion was coated at a laydown of 3.3 g Ag/m$^2$ in a vehicle of 2.5 g/m$^2$ gelatin and 0.55 g/m$^2$ latex copolymer of methyl acrylate, the sodium salt of 2-acrylamido-2-methylpropane sulphonic acid and 2-(methacryloyloxy)-ethylacetoacetate (88:5:7 by weight). Other addenda included 2-methylthio-4-hydroxy-5-carboxy-6-methyl-1,3,3a,7-tetraazaindene, 2-methylthio-4-hydroxy-6-methyl-1,3,3a,7-tetraazaindene, 1-(3-acetamidophenyl)-5-mercaptotetrazole, 4-carboxymethyl-4-thiazoline-2-thione and a thickener to achieve the required viscosity.

The interlayer was coated at a gelatin laydown of 0.65 g/m$^2$ and included a nucleating agent (Nucleator I) and 60 mg/m$^2$ amine booster (Booster I).

Nucleator I

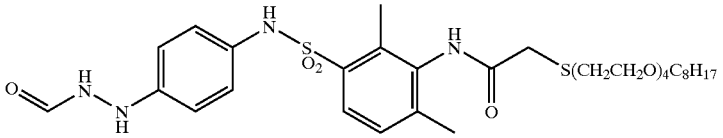

Booster I

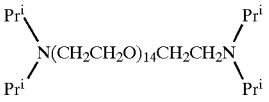

wherein Pr$^i$ is repesents isopropyl.

The supercoat contained matte beads and surfactant and was coated at a gelatin laydown of 1 g/m$^2$.

In order to evaluate the silver sludge-inhibiting agents a developer concentrate of the following formulation was prepared, diluted 1 part developer:2 parts water, and used as the developer and developer replenisher in a small standard processor.

TABLE 1A

| (weights in g/l) | |
|---|---|
| Potassium hydroxide (45.5% solution) | 89.0 |
| Sodium metabisulphite | 74.0 |
| Sodium bromide | 11.4 |
| Polymaleic acid solution (M. Wt. 800–1000) | 9.75 |
| Diethylenetriamine penta acetic acid, penta Na salt (40% solution) | 30.0 |
| Sodium hydroxide (50%) | 38.1 |
| Benzotriazole | 0.63 |
| Phenyl mercaptotetrazole | 0.039 |
| Diethylene glycol | 110.0 |
| Hydroquinone | 75.0 |
| 4-hydroxymethyl-4-methyl-1-phenyl-3-pyrazolidone | 2.4 |
| Potassium sulphite (45% solution) | 232.2 |
| Potassium carbonate | 54.4 |
| Component of invention | (see table 1B) |
| Water to 1 liter | |

The photographic element was exposed and developed using the developer composition through a small conventional roller transport processing machine at a rate of 45 m$^2$ per day for 9 tank turnovers and the processor was examined for cleanliness. The optical density of the top roller of the developer rack was measured to gauge the growth of silver sludging. The lower the roller optical density the more effective is the silver sludge-inhibiting agent. Tables 1B and 1C demonstrate the invention by the lower optical density readings obtained using developer solutions in accordance with the invention. The optical density readings were taken before and at intervals during processing corresponding to replenishment volumes in multiples of the original tank volume (called tank turn-overs or TTOs).

TABLE 1B

Experimental details.

| Expt. No. | Invention Component | Invention Component Addition (moles × $10^{-3}$/l in concentrate) | Replenishment Rate (mls/m$^2$) | Development Time (sec.) |
|---|---|---|---|---|
| 1 | None | — | 400 | 30 |
| 2 | None | — | 400 | 30 |
| 3 | GDPD | 0.19 | 400 | 30 |
| 4 | GDPD | 0.39 | 400 | 30 |
| 5 | GDPD | 1.92 | 400 | 30 |
| 6 | None | — | 150 | 30 |
| 7 | GDPD | 0.39 | 150 | 30 |
| 8 | GDPD | 1.92 | 150 | 30 |
| 9 | MTA | 4.18 | 150 | 30 |
| 10 | PDPD | 1.58 | 150 | 20 |

GDPD represents p-glutaramidophenyldisulfide, disodium salt
MTA represents the compound of formula (II) wherein A is paraphenylene, $R^1$ is —$(CH_2)_3$—, and X is —COOH.
PDPD represents the compound of formula (I) wherein A and B are each paraphenylene, $R^1$ and $R^2$ are each orthophenylene, and X and Y are each $SO_3^-K^+$.

TABLE 1C

Top roller optical densities.

| Expt. | TTOs | | | | | | | | |
|---|---|---|---|---|---|---|---|---|---|
| No. | 1 | 2 | 3 | 4 | 5 | 6 | 7 | 8 | 9 |
| 1 | | 0.4 | | 0.415 | | 0.411 | | 0.399 | 0.352 |
| 2 | 0.135 | 0.225 | 0.261 | | 0.296 | | 0.373 | | 0.387 |
| 3 | | | 0.1 | | | 0.2 | | | |
| 4 | | | | | 0.055 | | 0.13 | | |
| 5 | 0.013 | 0.006 | 0.017 | | 0.020 | | 0.027 | | 0.038 |
| 6 | 0.121 | 0.241 | | | | | | | |
| 7 | 0.074 | 0.116 | 0.139 | | | | | | |
| 8 | 0.008 | 0.022 | 0.051 | | 0.138 | | 0.178 | | 0.244 |
| 9 | 0.009 | 0.021 | 0.028 | | 0.048 | | 0.060 | | 0.070 |
| 10 | | | | | | | | | 0.237 |

EXAMPLE 2

When the disulphides used in the invention are added to the developer the sulphite therein attacks the —S—S— bond to form thiols and sulphonated thiols (Bunte salts). Both species are silver sludge-inhibiting agents but the thiols are preferred over the Bunte salts because they are more active. It has been discovered that certain types of compounds can affect the ratio of thiol to Bunte salt formed, but most desirable are those which increase the amount of thiol. To evaluate these thiol promoting compounds aliquots of a developer of formulation given in Table 1A were prepared containing various levels of a disulphide. To these solutions were added the thiol promoting compounds and the amount of thiol was measured analytically. The results can be seen in Table 2A.

TABLE 2A

| Disulphide Invention Component | Disulphide Invention Component Addition (moles × $10^{-3}$/l in concentrate) | Thiol Protecting Component | Thiol Protecting Component Addition (moles × $10^{-3}$/l in concentrate) | Thiol (moles × $10^{-3}$/l in concentrate) |
|---|---|---|---|---|
| GDPDA | 6.30 | — | — | 2.22 |
| GDPDA | 6.30 | MSA | 1.00 | 2.68 |
| GDPDA | 6.30 | MSA | 3.00 | 3.43 |
| GDPDA | 6.30 | MSA | 9.00 | >4.18 |
| GDPDA | 2.10 | — | — | 0.79 |
| GDPDA | 2.10 | MSA | 1.00 | 1.09 |
| GDPDA | 2.10 | MSA | 3.00 | 1.61 |
| GDPDA | 2.10 | MSA | 9.00 | 1.63 |
| GDPDA | 2.10 | Cysteine | 1.24 | 0.92 |
| GDPDA | 2.10 | Cysteine | 4.13 | 1.46 |
| GDPDA | 2.10 | Cysteine | 8.26 | 1.44 |
| GDPDA | 1.58 | Cysteine | 1.24 | 0.80 |

Figure 2:
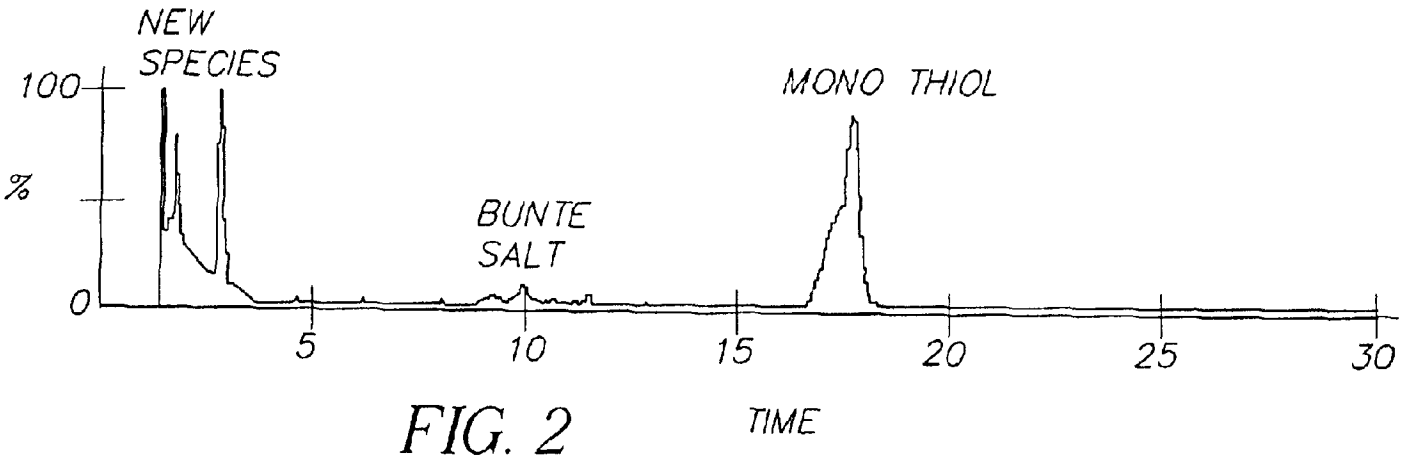
Figure 3:
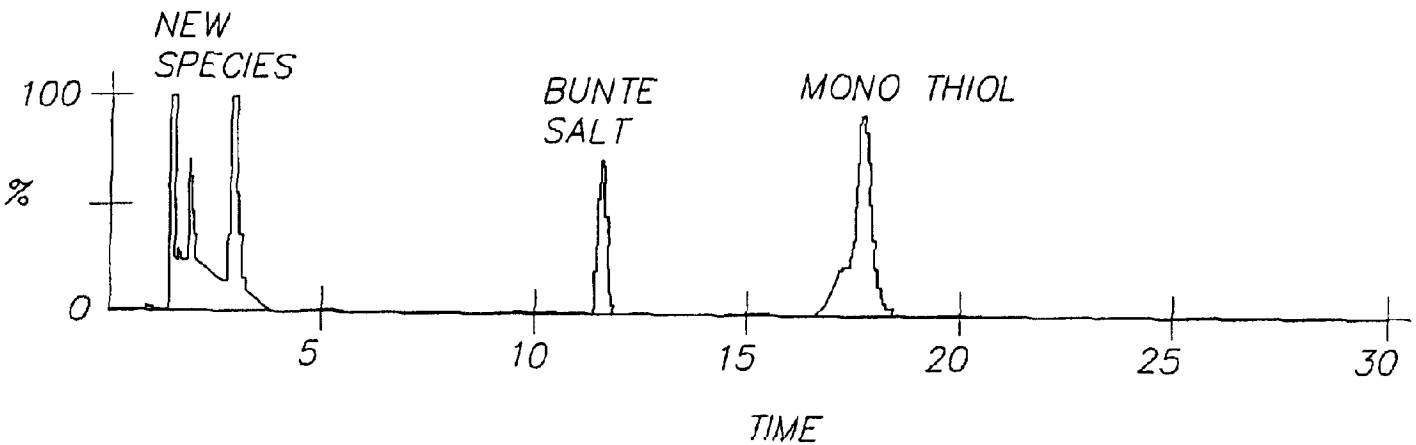

GDPDA represents p-glutaramidophenyldisulfide acid
MSA represents mercaptosuccinic acid In FIGS. 1 to 3 the results of an accelerated keeping experiment (21 days at 60 C.) are shown for aliquots of a developer formulation according to Table 1A with and without the presence of a thiol-promoting compound. The analytical technique used was LCMS (liquid chromatography mass spectrometry).

FIG. 1 represents the results obtained without a thiol promoting compound.

FIG. 2 represents the results obtained when the developer composition contained $9\times10^{-2}$ moles/l of sodium erythorbate.

FIG. 3 represents the results obtained when the developer composition contained $1.66\times10^{-3}$ moles/l of 5-mercaptobenzotriazole.

The results show that in the presence of sodium erythorbate or 5-mercaptobenzotriazole the formation of the monothiol is promoted over the Bunte salt.

Table 2C demonstrates how the amount of the silver sludge-inhibiting agents used in the invention can be reduced by the addition of a thiol-promoting compound. Two developers of formulations similar to that of Table 1 A were diluted 1 part developer:2 parts water and used to process film as described in Example 1.

TABLE 2C

| Silver Sludge-Inhibiting Component (moles × $10^{-3}$/l in concentrate) | Thiol Producing Component (moles × $10^{-3}$/l in concentrate) | Replenishment Rate (mls/m2) | Development Time (sec.) | Top Roller Optical Density |
|---|---|---|---|---|
| GDPDA(3.15) | None | 150 | 20 | 0.065 after 5TTO |
| GDPDA(1.05) | MSA(6.67) | 150 | 20 | 0.072 after 9TTO |

There is a loss of the thiol compound in the concentrate developer over time. Table 2D shows that although the percentage loss from the fresh position is approximately the same irrespective of the amount of silver sludge-inhibiting agent present, adding an appropriate amount of the thiol promoting agent boosts the fresh level of thiol and maintains this increase proportionally over time.

TABLE 2D

| Silver Sludge-Inhibiting Component (moles × $10^{-3}$/l in concentrate) | Thiol Promoting Component (moles × $10^{-3}$/l in concentrate) | Fresh Data (Thiol in (moles × $10^{-3}$/l in concentrate) | Data After 29 Days at Room Temp. (Thiol in (moles × $10^{-3}$/l in concentrate) |
|---|---|---|---|
| GDPDA(6.30) | None | 2.22 | 0.40 |
| GDPDA(6.30) | MSA(1.00) | 2.68 | 0.48 |
| GDPDA(6.30) | MSA(3.00) | 3.43 | 0.63 |
| GDPDA(2.10) | None | 0.79 | 0.13 |
| GDPDA(2.10) | MSA(1.00) | 1.08 | 0.21 |
| GDPDA(2.10) | MSA(3.00) | 1.61 | 0.31 |
| GDPDA(2.10) | MSA(9.00) | 1.63 | 0.33 |

EXAMPLE 3

While some silver sludge-inhibiting compounds form insoluble silver salts and cause a precipitate themselves e.g. the silver salt of 2-mercapto-benzothiazole(2 MBT), the compounds used in the invention form soluble salts. However, when certain of these compounds forming insoluble silver salts are added to a developer containing any of the silver sludge-inhibiting compounds of the invention, surprisingly, their tendency to precipitate is substantially reduced or eliminated entirely. Table 3A shows examples of this where aliquots of developers of formulations similar to those of Table 1A were made containing the silver sludge-inhibiting compounds used in the invention and also the compounds that ordinarily would form insoluble silver salts.

TABLE 3A

| Silver Sludge-Inhibiting Compound (moles × $10^{-3}$/l in concentrate) | Compound Forming Insoluble Silver Salt | Compound Forming Insoluble Silver Salt (moles × $10^{-3}$/l in concentrate) | Replenishment Rate (mls/$m^2$) | 2MBT Precipitate | Silver Sludging |
|---|---|---|---|---|---|
| None | None | — | 400 | No | Yes |
| None | 2MBT | 1.35 | 400 | Yes | No |
| None | 2MBT | 1.88 | 150 | Yes | No |
| GDPDA (1.05) | 2MBT | 0.90 | 150 | No | No |
| GDPDA (3.15) | 2MBT | 0.90 | 150 | No | No |
| GDPDA (2.10) | 2MBT | 0.60 | 150 | No | No |
| GDPDA (0.53) | 2MBT | 0.60 | 150 | No | No |

EXAMPLE 4

Aliquots of a developer concentrate similar to that of the formulation in table 1A were made containing the silver sludge-inhibiting agent GDPDA with and without the thiol producing agent MSA. The solutions were then diluted to various degrees and the amount of thiol measured. Surprisingly, the thiol found was greater in every case than that predicted.

TABLE 4A

| Silver Sludge-Inhibiting Compound (moles × $10^{-3}$/l in concentrate) | Thiol Producing Compound (moles × $10^{-3}$/l in concentrate) | Concentrate (Thiol in moles × $10^{-3}$/l in concentrate) | Dilution 1 + 2 Thiol in moles × $10^{-3}$/l in concentrate) | Dilution 1 + 8 Thiol in moles × $10^{-3}$/l in concentrate) |
|---|---|---|---|---|
| GDPDA(6.30) | None | 2.22 | 2.13 | 0.54 |
| GDPDA(6.30) | MSA(1.00) | 2.68 | 2.57 | 0.69 |
| GDPDA(6.30) | MSA(3.00) | 3.43 | 3.39 | 0.88 |
| GDPDA(6.30) | MSA(9.00) | >4.20 | >4.2 | 1.40 |
| GDPDA(2.10) | None | 0.79 | 0.63 | ND |
| GDPDA(2.10) | MSA(1.00) | 1.09 | 1.05 | ND |
| GDPDA(2.10) | MSA(3.00) | 1.61 | 1.57 | ND |
| GDPDA(2.10) | MSA(9.00) | 1.63 | 1.59 | ND |

ND = no data

EXAMPLE 5

A photographic element was made as described in Example 1 except that the antihalation pelloid further comprised para-glutaramidophenyldisulphide disodium salt (GDPD) at a concentration of 50 mg/$m^2$.

This coating was processed through a small conventional roller transport processing machine at a rate of 45 $m^2$ per day for 9 tank turnovers and the processor was examined for cleanliness. This run was compared to a control run using a film which was prepared in the absence of the silver sludge-inhibiting agent. The composition of the developer was similar to that formulated in Table 1A without the silver sludge-inhibiting agent. The results are documented in Table 5A and demonstrate that the developer tank rollers at 9TTO using the film containing the silver sludge-inhibiting agent are cleaner than those at only 2TTO using the film with no incorporated agent.

TABLE 5A

| GDPD in Film (in terms of moles × $10^{-3}$/l in developer concentrate) | GDPD in Developer (moles × $10^{-3}$/l in concentrate) | Replenishment Rate (mls/m2) | Development Time (sec.) | Top Roller Optical Density |
|---|---|---|---|---|
| None | None | 150 | 30 | 0.241 after 2TTO |
| None | 1.92 | 150 | 30 | 0.244 after 9TTO |
| 1.92 | None | 150 | 20 | 0.219 after 9TTO |

The invention has been described in detail with particular reference to certain preferred embodiments thereof, but it will be understood that variations and modifications can be effected within the spirit and scope of the invention.

What is claimed is:

1. A photographic developer composition for use in the development of a black and white silver halide photographic element, said composition comprising at least one developing agent and, in an amount sufficient to inhibit sludge deposition, one or more compounds selected from compounds having the formula $$X—R^1—CONH—A—S—S—B—NHCO—R^2—Y \quad (I)$$

wherein

A and B are each independently a substituted or unsubstituted aliphatic, alicyclic, aromatic or heterocyclic group;

$R^1$ and $R^2$ are each independently a substituted or unsubstituted aliphatic, alicyclic, aromatic or heterocyclic group;

X and Y are each independently a solubilising group;

and compounds having the formula $$X—R^1—CONH—A—S—M \quad (II)$$

wherein A and X are as defined above;

$R^1$ is a substituted or unsubstituted aliphatic or alicyclic group; and

M is either a hydrogen atom or a cationic species if the sulfur atom is in its ionised form.

2. A composition according to claim 1 wherein A and B are selected from a substituted or unsubstituted alkylene group having from 1 to 12 carbon atoms, a cycloalkylene group having from 5 to 8 ring carbon atoms, an aromatic group having from 5 to 10 ring carbon atoms, a heterocyclic group having from 5 to 10 ring atoms, said ring atoms being selected from selected from C, N, S, and O.

3. A composition according to claim 1 wherein A and B are phenylene groups.

4. A composition according to claim 1 wherein $R^1$ and $R^2$ are selected from a substituted or unsubstituted alkylene group having from 1 to 12 carbon atoms and a cycloalkylene group having from 5 to 8 ring carbon atoms.

5. A composition according to claim 1 wherein $R^1$ and $R^2$ represent $—(CH_2)_3—$.

6. A composition according to claim 1 wherein the X and Y groups are selected from quaternary ammonium groups and carboxylic, sulfonic, sulfinic and phosphonic groups in acid or salt form.

7. A composition according to claim 1 wherein A and B each represent paraphenylene, $R^1$ and $R^2$ each represent $—(CH_2)_3—$ and, X and Y each represent —COOM wherein M is either a hydrogen atom or a cationic species if the carboxyl group is in its ionised form.

8. A composition according to claim 1 wherein compound (I) and/or (II) is present in the developer composition in an amount sufficient to provide a concentration of from $7\times10^{-6}$ to $7\times10^{-3}$ mol/l of working strength developing solution.

9. A composition according to claim 1 further comprising a compound having the formula $$Q—S—H \quad (III)$$

wherein Q represents a substituted or unsubstituted heterocyclic group, the silver salt of said compound being water insoluble.

10. A composition according to claim 9 wherein the heterocyclic group has from 5 to 10 ring atoms selected from C, N, S, and O.

11. A composition according to claim 9 wherein the heterocyclic group is benzothiazole group.

12. A composition according to claim 9 wherein the compound of formula (III) is present in the developer composition in an amount sufficient to provide a concentration of from $2\times10^{-5}$ to $5\times10^{-3}$ mol/l of working strength developing solution.

13. A composition according to claim 1 wherein the developing agent is selected from dihydroxybenzene and ascorbic acid developing agents.

14. A photographic developer composition according to claim 1 wherein the thiol promoting compound is mercaptosuccinic acid.

15. A photographic developer composition for use in the development of a black and white silver halide photographic element said composition comprising at least one developing agent and, in an amount sufficient to inhibit sludge deposition, one or more compounds selected from compounds having the formula $$X—R^1—CONH—A—S—S—B—NHCO—R^2—Y \quad (I)$$

wherein

A and B are paraphenylene;

$R^1$ and $R^2$ each represent $—(CH_2)_3—$;

X and Y each represent —COOM wherein M is either a hydrogen atom or a cationic species if the carboxyl group is in its ionised form;

and compounds having the formula $$X—R^1—CONH—A—S—M \quad (II)$$

wherein A, $R^1$ and X are as defined above, and

M is either a hydrogen atom or a cationic species if the sulfur atom is in its ionised form and further comprising mercaptosuccinic acid.

* * * * *